United States Patent [19]

Becker et al.

[11] Patent Number: 4,975,091

[45] Date of Patent: Dec. 4, 1990

[54] TEXTILE DRAWING AIDS FOR FIBER MATERIALS CONTAINING POLYESTER

[75] Inventors: Wolfgang Becker, Moenchengladbach; Guenter Uphues, Monheim; Uwe Ploog, Haan, all of Fed. Rep. of Germany

[73] Assignee: Henkel Kommanditgesellschaft auf Aktien, Duesseldorf, Fed. Rep. of Germany

[21] Appl. No.: 327,210

[22] Filed: Mar. 22, 1989

[30] Foreign Application Priority Data

Mar. 24, 1988 [DE] Fed. Rep. of Germany ..... 3809928

[51] Int. Cl.[5] ..... D06M 15/00

[52] U.S. Cl. ..... 8/115.66; 8/115.58; 8/DIG. 4; 252/8.6; 252/8.8

[58] Field of Search ..... 252/8.8, 8.6, 188; 8/DIG. 4, 115.54, 115.55, 115.66, 115.58

[56] References Cited

U.S. PATENT DOCUMENTS 3,984,335 10/1976 Ciko et al. ..... 252/8.6

FOREIGN PATENT DOCUMENTS 3032216 4/1982 Fed. Rep. of Germany .
3618944 6/1986 Fed. Rep. of Germany .
59-47478 3/1984 Japan .
1074603 5/1967 United Kingdom .

OTHER PUBLICATIONS

"Textile Finishing", *Springer-Verlag*, 2nd edition, pp. 256–258, 1967.

Handbook of Textile Acids, *Verlag Chemie Weinheim*, 1967, pp. 689–692.

Ullmanns Encyclopadie der tech., Chemie, Bd. 11.

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

Mixtures which contain oxidized polyethylenes and selected quaternary ammonium phosphates are used as textile drawing aids for rendering polyester-containing fiber materials antistatic, smooth and/or soft.

15 Claims, No Drawings

TEXTILE DRAWING AIDS FOR FIBER MATERIALS CONTAINING POLYESTER

BACKGROUND OF THE INVENTION

1. Field of the Invention:

The invention relates to mixtures which contain oxidized polyethylenes and selected quaternary ammonium phosphates, as well as the use of these mixtures as textile drawing aids for rendering fiber materials containing polyester antistatic, smooth and/or soft.

2. Discussion of Related Art:

Re-texturing is part of the textile finishing process and is intended to impart to flock, slubbing, fabric, knitted goods or non-woven materials in particular such properties as feel, smoothness, anti-static properties and body as a result of which their appearance, marketability, effectiveness in use and processing qualities are improved The textile aids used for re-texturing can, for example, be applied to textile fiber materials in a total immersion bath (exhaustion process). In the total immersion treatment the textiles are wetted for a long period at a high wash-liquor ratio and then de- watered by squeezing, extraction or centrifuging. Compared to other treatment processes such as foularding, padding, doctoring or spraying, the total-immersion treatment has the advantage that the treatment times and temperatures can be chosen and varied at will (see for example W. Bernard: "Appretur der Textilien" [Textile Finishing], 2nd. edition, pp. 257–258, Springer-Verlag 1967).

However, the exhaustion process is economical only if textile aids are used which have a sufficiently high substantivity for fiber materials and therefore make possible a good exhaustion of the treatment liquors. Cationic textile aids which impart anti-static and/or fabric-softening properties to fiber materials exhibit a high substantivity with respect to natural fibers, e.g. cellulose, cotton and/or wool, while their affinity to the majority of synthetic materials, particularly polyester fibers, is distinctly lower (Chwala/Anger: "Handbuch der Textilhilfsmittel" [Handbook of Textile Aids], pp. 689–692, Verlag Chemie Weinheim 1967).

Fatty polyamine condensation products, fatty acid amide derivatives, paraffin emulsions and silicon derivatives are usually employed as anti-static agents, smoothing agents and/or softeners in the exhaustion process. It is, however, a disadvantage that these substances have only an insufficient substantivity in relation to fiber materials containing polyester. Moreover, fiber materials containing polyester have either no anti-static, smoothness and/or softness qualities or at best only unsatisfactory ones after the re-texturing process.

A basic object of the invention therefore comprises in the development of textile aids which have a high substantivity for fiber materials containing polyester and which impart excellent anti-static, smoothing and/or softening properties to these fiber materials.

DESCRIPTION OF THE INVENTION

Other than in the operating examples, or where otherwise indicated, all numbers expressing quantities of ingredients or reaction conditions used herein are to be understood as modified in all instances by the term "about".

It has been found that mixtures containing oxidized polyethylenes and certain quaternary ammonium phosphates have a high affinity for fiber materials containing polyester.

Accordingly, the invention comprises mixtures containing:

(A) oxidized polyethylenes having an average molecular weight between 3000 and 8000, an acid value between 25 and 60, a saponification value between 40 and 80 and a density between 0.94 and 1.09 g/cm$^3$, and (B) at least one quaternary ammonium phosphate selected from one of the following groups:

(1.)
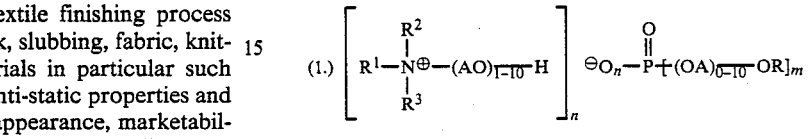

in which $R^1$ represents a saturated or unsaturated, straight- or branched-chain, substituted or unsubstituted alkyl group with 6 to 22 carbon atoms or

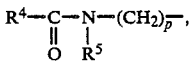

$R^2$ represents $(AO)_{1-5}$—H, methyl or ethyl, $R^3$ represents $(AO)_{1-5}$—H, methyl or ethyl or $R^2$ and $R^3$ together represent —$CH_2CH_2$—O—$CH_2CH_2$—, $R^4$ represents a saturated or unsaturated, straight- or branched- chain, substituted or unsubstituted alkyl group with 5 to 21 carbon atoms, $R^5$ represents H or an alkyl group with 1 to 4 carbon atoms, R represents a saturated or unsaturated, straight- or branched- chain, substituted or unsubstituted alkyl group with 6 to 22 carbon atoms, and A represents an alkylene chain with 2 to 4 carbon atoms, p is 2 or 3, and n=1, m=2 or n=2, m=1;

(2.)
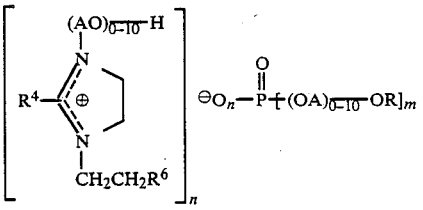

in which $R^4$ represents a saturated or unsaturated, straight- or branched-chain, substituted or unsubstituted alkyl group with 5 to 21 carbon atoms, $R^6$ represents OH or

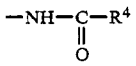

R represents a saturated or unsaturated, straight- or branched- chain, substituted or unsubstituted alkyl group with 6 to 22 carbon atoms, and A represents an alkylene chain with 2 to 4 carbon atoms, and n=1, m=2 or n=2, m=1;

(3.) quaternary ammonium phosphates based on polyesters with amino functions, produced by the reaction of dicarboxylic acids of the general formula $$HOOC—R^7—COOH$$

in which $R^7$ represents an aliphatic, alicyclic or aromatic, substituted or unsubstituted radical with 1 to 10 carbon atoms, with alkoxylated tertiary amines of the general formula $$H—(OA^1)_a—\underset{\underset{R^8}{|}}{N}—(A^1O)_b—H$$

in which $R^8$ represents a saturated or unsaturated, straight- or branched- chain, substituted or unsubstituted alkyl radical with 1 to 20 carbon atoms, and $A^1$ represents an alkylene chain with 2 to 3 carbon atoms, a and b each represent an integer between 1 and 20 with the proviso that the sum of a+b is from 2 to 30 and the degree of polymerization of the polyester is from to 2 to 50, and subsequent mixing of the polyester with amino functions obtained at 50° to 80° C. in the presence of water with mono- and/or di-alkyl phosphoric acid esters of the general formulae $$(HO)_2\overset{\overset{O}{\|}}{P}—(OA)_{\overline{0-10}}—OR, \text{ and}$$

$$HO—\overset{\overset{O}{\|}}{P}—[(OA)_{\overline{0-10}}—OR]_2$$

in which

R represents a saturated or unsaturated, straight- or branched- chain, substituted or unsubstituted alkyl group with 6 to 22 carbon atoms, and A represents an alkylene chain with 2 to 4 carbon atoms, and then reaction with an alkylene oxide containing 2 to 4 carbon atoms at a pressure between 1 and 5 bar and a temperature between 80° and 100° C., with the proviso that the polyalkylether chain of the quaternized amine functions contains 1 to 10 alkylene oxide units.

In the mixtures according to the invention the weight ratio of the components A:B lies preferably between 10:1 and 1:5, and especially preferably between 10:3 and 1:2.

From Japanese patent application JP No. 59/47478 it is known to use quaternary ammonium phosphates of the general formula $$R_1—\overset{\overset{R_2}{|}}{\underset{\underset{R^3}{|}}{N}}^{\oplus}—R_2.X^{\ominus}$$

in which $R_1$ represents an alkyl- or alkenyl group with 8 to 22 carbon atoms, $$R_5—\underset{\underset{O}{\|}}{C}—NH—(CH_2)_{\overline{m}}$$

or beta-hydroxyalkyl, $R_2$ and $R_3$ independently of each other represent an alkyl- or alkenyl group with 1 to 22 carbon atoms, a benzyl group or $—(AO)_n—H$ or $R_2$ and $R_3$ represent $—CH_2CH_2—O—CH_2CH_2—$, $R_4$ represents $(OCH(R_6)CH_2)—OH$, $R_5$ represents an alkyl- or alkenyl group with 7 to 21 carbon atoms, $R_6$ represents H or an alkyl group with 1 to 18 carbon atoms, X represents the anion of an organic phosphoric acid ester of the general formula $$\left[R_7—O—(A^1O)_{\overline{p}}\right]_q\overset{\overset{O}{\|}}{P}—(OH)_{3-q}$$

$R_7$ represents an alkyl- or alkenyl group with 8 to 22 carbon atoms,

A and $A^1$ represent an alkylene group with 2 to 4 carbon atoms, m is 1 to 3, n is 1 to 20, l is 1 to 5, p is 0 to 20, and q is 1 or 2, as anti-static agents for synthetic textile fibers, e.g. polyester fibers.

Surprisingly, both the anti-static effect and the smoothness of fiber materials containing polyester are clearly improved by the combination of certain quaternary ammonium phosphates (component (B) 1–3) with oxidized polyethylenes (component A). The mixtures according to the invention furthermore give fiber materials containing polyester a good feel.

The use of mixtures containing an oxidized polyethylene having an average molecular weight of between 3000 and 8000, an acid value between 25 and 60, a saponification value between 40 and 80 and a density between 0.94 and 1.09 g/cm$^3$, and at least one quaternary ammonium phosphate from at least one of the groups (B) 1–3, as textile auxiliaries for rendering polyester-containing fiber materials anti-static, smooth and/or soft is therefore also a subject of the invention.

Oxidized polyethylenes having an average molecular weight between 3500 and 5000 and a density between 0.98 and 1.00 g/cm$^3$ are preferred in the mixtures according to the invention.

As component B, those quaternary ammonium phosphates of the general formulae in (B) 1–3 are used in which the radicals represent the following:

$R^1$ is a saturated, straight- or branched-chain, substituted or unsubstituted alkyl group with 8 to 18 carbon atoms, an unsaturated, straight or branched-chain, substituted or unsubstituted alkyl group with 18 to 22 carbon atoms or $$R^4—\underset{\underset{O}{\|}}{C}—\underset{\underset{H}{|}}{N}—(CH_2)_{\overline{p}}—,$$

$R^4$ is a saturated, straight- or branched-chain, substituted or unsubstituted alkyl group with 7 to 17 carbon atoms or an unsaturated, straight- or branched-chain, substituted or unsubstituted alkyl group with 17 to 21 carbon atoms, $R^6$ is OH, $R^8$ is a saturated or unsaturated, straight- or branched-chain, substituted or unsubstituted alkyl group with 6 to 20 carbon atoms, R is a saturated, straight- or branched-chain, substituted or unsubstituted alkyl group with 8 to 18 carbon atoms or an unsaturated straight- or branched-chain, substituted or unsubstituted alkyl group with 18 to 22 carbon atoms, and A is an ethylene group or an isopropylene group.

The mixtures according to the invention, which preferably exist in the form of dispersions or solutions, and especially preferably in the form of aqueous emulsions, preferably contain between 5 and 50% by weight, and especially preferably between 10 and 30% by weight of the components A and B. The dispersions or solutions, and preferably aqueous emulsions, are applied to fiber materials containing polyester in a manner known per se in post-wash rinses, wash baths or dip baths or by spray processes and are dried by spinning, squeezing and temperature treatment at between 80° and 160° C. The application of the mixtures according to the invention preferably takes place in the exhaustion process from aqueous liquors at a liquor ratio between 1:5 and 1:25, with pH values of the liquor between 4.0 and 7.0, and at temperatures between 40° and 80° C. Because textile auxiliaries containing component A and component B according to the invention have a high affinity for fiber materials containing polyester, a high consumption of the treatment liquors is achieved.

The term "fiber materials containing polyester" is intended to include pure polyester fibers and also mixtures of polyester fibers and natural and/or synthetic fibers, e.g. mixtures of polyester fibers and cotton; polyester fibers and polyamide fibers; polyester fibers, cotton and polyamide fibers; or polyester fibers and polyacrylic fibers. The textile fiber materials take the form of flock, slubbing, yarn, woven goods, fabric or nonwoven materials, and preferably of flock or slubbing. The material can be unbleached, bleached or colored.

The oxidized polyethylenes contained in the mixtures according to the invention are products available in commerce, e.g. from Allied Corp., USA under the name A-C® polyethylenes.

The production of the quaternary ammonium phosphates contained in the mixtures according to the invention takes place according to the process described in Japan patent application No. 59/47478 in which amines, imidazolines and/or polyesters with amino functions, obtained according to German Pat. No. 30 32 216 by the condensation of alkoxylated tertiary amines with dicarboxylic acids, are mixed with phosphoric acid esters of the general formulae $$(HO)_2-\overset{\overset{\displaystyle O}{\|}}{P}-(OA)_{\overline{0-10}}OR, \text{ and}$$

$$HO-\overset{\overset{\displaystyle O}{\|}}{P}-[(OA)_{\overline{0-10}}OR]_2$$

in which

R represents a saturated or unsaturated, straight- or branched- chain, substituted or unsubstituted alkyl group with 6 to 22 carbon atoms, and A represents an alkylene chain with 2 to 4 carbon atoms, at 50° to 80° C. and then these mixtures are reacted in an autoclave at 80° to 100° C. with alkylene oxides containing 2 to 4 carbon atoms, with the proviso that the polyalkylether chain of the quaternized amine functions consists of 1 to 10 alkylene oxide units.

The amines, imidazolines and polyesters containing amino functions and also the phosphoric acid partial esters required as educts for the production of quaternary ammonium phosphates can be obtained by means of processes known from the literature:

Amines, which can be produced e.g. by the hydrogenation of fatty acid nitriles (Ullmanns Encyclopaedie der technischen Chemie, Volume 11, pp. 448–449, Verlag Chemie, Weinheim 1976) or directly from fatty alcohols and ammonia as in Great Britain No. 1,074,603, are reacted preferably with ethylene oxide and/or propylene oxide at temperatures between 130° and 180° C. with the proviso that the polyalkylether chains of the tertiary amines formed consist of 1 to 5 ethylene oxide and/or propylene oxide units. Cocinyl amine, oleyl amine, tallow amine, cocinyl alkyl-di-2- hydroxyethylamine, dimethyl-lauryl amine and N-$C_{12-14}$-alkyl morpholine are examples of amines which are suitable for the production of quaternary ammonium phosphates. Coconut fatty acyl amidopropyl-dimethyl-amine should be noted as an example of an acylated amine. The imidazolines required as starting materials for the production of quaternary imidazolinium phosphates can be produced by the condensation of carboxylic acids, carboxylic acid esters or carboxylic acid chlorides with diamine compounds (G. Gawalek: "Tenside" [Surfactants], pp. 305–306, Akademie Verlag, Berlin 1975). The production of the imidazolines preferably takes place as in German Pat. No. 36 18 944 by the condensation of carboxylic acids of the general formula $R^4$—COOH, in which $R^4$ represents a straight- or branched-chain saturated or unsaturated, substituted or unsubstituted alkyl group with 5 to 21 carbon atoms, with diamines of the general formula $H_2N$—CHhd $2CH_2$—N-H—$CH_2CH_2R^6$, in which $R^6$ represents OH or $$-NH-\underset{\underset{\displaystyle O}{\|}}{C}-R^4.$$

The condensation is carried out at temperatures between 150° and 240° C., preferably between 150° and 200 ° C. The molar ratio of carboxylic acid:diamine lies preferably between 1:1 and 1:2.

For the production of the imidazolines the carboxylic acids can be used both singly and in mixtures. Of particular significance is the use of fatty acid mixtures, such as occur during the separation of naturally occurring fats and/or oils. Some fractions of these fatty acid mixtures are also suitable for the production of the imidazolines. As carboxylic acids those preferably used are of the general formula $R^4$—COOH in which the radical $R^4$ stands for a straight- or branched-chain, substituted or unsubstituted, saturated alkyl group with 7 to 17 carbon atoms or for a straight- or branched-chain, substituted or unsubstituted, unsaturated alkyl group with 17 to 21 carbon atoms, e.g. caprylic acid, capric acid, lauric acid, palmitic acid, stearic acid, oleic acid, linoleic acid, linolenic acid, gadoleic acid and/or ricinoleic acid.

1- Hydroxyethyl-2-undecylimidazoline, 1-hydroxyethyl-2-heptadecenyl- imidazoline and 1-hydroxyethyl-2-heptylimidazoline are suitable imidazolines.

Polyesters with amino functions as are obtained in German Pat. No. 30 32 216 by the condensation of alkoxylated tertiary amines of the general formula $$H-(OA^1)_a-\underset{\underset{R^8}{|}}{N}-(A^1O)_b-H$$

in which $R^8$ represents a saturated or unsaturated, straight- or branched- chain, substituted or unsubstituted alkyl radical with 1 to 20 carbon atoms, and $A^1$ represents an alkylene chain with 2 to 3 carbon atoms, a and b are integers between 1 and 20 with the proviso that the sum of a and b is from 2 to 30, with dicarboxylic acids of the general formula HOOC—$R^7$—COOH, in which the radical $R^7$ represents an aliphatic, alicyclic or aromatic, substituted or unsubstituted radical with 1 to 10 carbon atoms, at temperatures between 180° and 260° C., possibly in the presence of non-water-miscible organic solvents, e.g. xylene or toluene, for the azeotropic removal of reaction by-products while excluding atmospheric oxygen. The polyesters with amino functions have degrees of polymerization between 2 and 50 when 0.8 to 1.1 mole of dicarboxylic acid is used per mole of alkoxylated tertiary amine. As the aliphatic, alicyclic and/or aromatic, possibly substituted dicarboxylic acids, for example, the following can be used; malonic acid, maleic acid, fumaric acid, succinic acid, hydroxymalonic acid, malic acid, chlorethane-dicarboxylic acid, oxalic acid and/or terephthalic acid. In the case of oxalic acid, $R^7$ is not present in the general formula. Particularly suitable aliphatic dicarboxylic acids include acids with 6 to 10 carbon atoms, such as adipic acid, pimelic acid, suberic acid, azelaic acid and/or sebacic acid.

Derivatives of these acids can also be used instead of the free acids in equimolar amounts with the same result, e.g. anhydrides, halides, dimethyl esters. However, the free dicarboxylic acids are preferably used. The alkoxylated tertiary amines required for the production of polyesters with amino functions may be derived from primary alkyl- and/or alkenyl amines, e.g. from methylamine, ethylamine, butylamine, octylamine, decylamine, dodecylamine, cetylamine, oleylamine, linoleylamine, cocinylamine and/or tallow amine. Alkyl amines which are produced from coconut oil or tallow are preferred. Alkyl- and/or alkenyl amines are alkoxylated in a manner known per se at temperatures between 130° and 180° C. with ethylene oxide and/or propylene oxide with the proviso that the degree of alkoxylation (sum of a and b) lies between 2 and 30.

Examples of suitable polyesters with amino functions include polyesters obtained from tallow amine containing 5 ethylene oxide units (EO) and adipic acid, polyesters from cocinyl amine containing 2 EO and adipic acid, polyesters from cocinyl amine containing 5 EO and succinic acid and/or polyesters from tallow amine containing 10 EO and sebacic acid.

The production of the phosphoric acid partial esters usually begins with straight- or branched-chain, saturated or unsaturated, substituted or unsubstituted, possibly alkoxylated alcohols with 6 to 22 carbon atoms. Preferably straight- or branched chain, substituted or unsubstituted, saturated, possibly alkoxylated alcohols with 8 to 18 carbon atoms and/or straight- or branched-chain, substituted or unsubstituted, unsaturated, possibly alkoxylated alcohols with 18 to 22 carbon atoms are used, for example, 2-ethylhexanol, n-octanol, isononyl alcohol, decyl alcohol, dodecyl alcohol, isotridecylalcohol, tetradecyl alcohol, hexadecyl alcohol, octadecyl alcohol, octadecenyl alcohol, eicosenyl alcohol, or docosenyl alcohol. These alcohols are reacted if necessary with 1 to 10 moles of ethylene oxide, propylene oxide and/or butylene oxide. The phosphating of the optionally alkoxylated alcohols takes place in a manner known per se, in which 3 moles of alcohol is reacted with mole of phosphorus pentoxide at 50° to 80 ° C. For hydrolysis of the polyphosphoric acid compounds, treatment with water is carried out for several hours at 90° to 100° C.

When the mixtures according to the invention are used as textile auxiliaries for rendering polyester containing fiber materials antistatic, smooth and/or soft, these mixtures preferably take the form of dispersions or solutions, and especially desirably take the form of aqueous emulsions. Such emulsions contain 2 to 20% by weight of nonionic, cationic and/or amphoteric dispersants. Suitable nonionic dispersants include alkoxylated, preferably ethoxylated and/or propoxylated fats, oils, and fatty alcohols with 8 to 24 carbon atoms in the fatty radical, fatty amines with 8 to 24 carbon atoms in the fatty radical and/or $C_{8-18}$-alkylphenols, e.g. ethoxylated castor oil, oleyl alcohol . 5 EO, oleylcetyl alcohol . 5 EO, tallow alcohol . 14 EO, stearyl amine . 2 EO, tallow amine . 2 EO, stearyl amine . 10 EO and/or nonyl phenol . 10 EO. As cationic dispersants, alkoxylated, preferably ethoxylated and/or propoxylated alkyl amines with 10 to 20 carbon atoms can be used in the form of their ammonium salts, e.g. stearyl amine . 10 EO. As amphoteric dispersants, e.g. $C_{8-22}$-alkyldimethylbetaines, N-$C_{8-22}$-alkylamidobetaines and/or amphoteric surfactants derived from amino acids are suitable.

As optional constituents the solutions or dispersions can contain further smoothing agents, e.g. paraffins with softening temperatures between 35° and 80° C., fatty acid esters with 12 to 24 carbon atoms both in the fatty acid radical and in the straight- and/or branched-chain, saturated and/or unsaturated alcohol radical such as isotridecyl- stearate, stearyl-stearate and/or behenyl-behenate and/or silicones such as dimethylpolysiloxane, softeners such as fatty acid amidopolyamines and/or quaternary ammonium salts, e.g. dimethyl distearyl-ammonium chloride, antioxidants, e.g. oxyacids of phosphorus and/or alkali metal disulfites and pH-value adjusters, e.g. $C_{1-4}$-carboxylic acids and/or $C_{1-4}$-hydroxycarboxylic acids such as acetic acid and/or glycolic acid. The proportion of the optional constituents in the aqueous dispersions and emulsions is between 2 and 20% by weight. The production of the dispersions and solutions, preferably aqueous emulsions, which contain the mixtures according to the invention, takes place in a manner known per se, in which oxidized polyethylenes, dispersants and optional constituents are mixed with water and stirred in a pressure-resistant apparatus at 130° to 170° C. After cooling, finely-dispersed, storage-stable emulsions are obtained into which quaternary ammonium phosphates and if necessary further dispersants are stirred.

Storage-stable, liquid, milky-white emulsions with solid contents of 5 to 50% by weight are formed. Adjustment to a pH value of 3.0 to 6.0 is achieved by the addition of acids, preferably acetic acid, glycolic acid or lactic acid.

The mixtures according to the invention are heat-resistant and do not cause discoloration of the fiber materials. The fiber materials containing polyester which are finished with the mixtures according to the invention have distinctly reduced electrostatic charges, low static and dynamic fiber/fiber and fiber/metal friction, an outstanding smoothness and a good soft feel in comparison to fiber materials containing polyester which are untreated or treated only with oxidized polyethylenes or only with quaternary ammonium phosphates.

Examples:

1. Production of stable, aqueous emulsions containing oxidized polyethylenes (component A).

1.1

5.0 g oleyl cetyl alcohol containing 5 moles of ethylene oxide
8.1 g oxidized polyethylene (average molecular weight=4000, acid value (AV)=28, saponification value (SV)=45, density=0.99 g/cm$^3$)
2.6 g paraffin (melting point=52° to 54° C.)
1.7 g stearic acid-isotridecylester
2.4 g stearyl amine containing 2 moles ethylene oxide
0.2 g sodium bisulfite
11.9 g acetic acid, 60% by weight
63.1 g water The listed substances used were mixed at 155° to 165 ° C, with stirring in a pressure apparatus. 95 g of a finely dispersed emulsion with a pH value of 4.1 was obtained.

1.2 5.0 g oleyl cetyl alcohol containing 5 moles of ethylene oxide 0.9 g oxidized polyethylene (average molecular weight=500, AV=30, SV=45, density=1.00 g/cm$^3$)
3.1 g stearyl amine . 10 EO
0.3 g sodium bisulfite
11.9 g acetic acid, 60 % by weight
58.8 g water From the above substances, 90 g of a finely dispersed emulsion was produced as in 1.1, the pH value of which was 3.9.

1.3

5.0 g oleyl alcohol . 5 EO
6.5 g oxidized polyethylene as in 1.1
1.7 g fatty acid amidopolyamine from 2 mole behenic acid and 1 mole tetraethylenepentamine
0.7 g tallow alcohol . 14 EO
0.8 g dimethyl polysiloxane (viscosity=12,500 cSt)
12.0 g acetic acid, 60% by weight
1.5 g stearyl amine . 5 EO
0.2 g sodium bisulfite
51.6 g water From the above substances, 80 g of a finely dispersed emulsion was produced as in 1.1, the pH value of which was 4.1.

2. Production of quaternary ammonium phosphates (component B)

2.1

127.4 g (0.47 mole ) of cocinyl-alkyl-di-2-hydroxyethyl-amine was placed in an autoclave together with 80.0 g of water and 88.4 g (0.47 acid equivalents) of a mixture of mono- and di-2-ethyl hexyl phosphoric acid ester in the weight ratio 4:3 and brought to reaction over the course of 4 hours with 104.0 g (2.35 mole) ethylene oxide at 80° C./3 bar. 392 g was obtained of a low-viscosity liquid which could be diluted with water without gel formation.

2.2 126 g (0.47 mole) 1-hydroxyethyl-2-undecylimidazoline was placed in an autoclave together with 80.0 g of water and 88.4 g (0.47 acid equivalents) of a mixture of mono- and di-2-ethylhexylphosphoric acid ester in the weight ratio 4:3 and brought to reaction within 4 hours with 103.4 g (2.35 mole) of ethylene oxide at 80° C./3 bar. 395 g was obtained of a yellow, low-viscosity liquid which could be diluted with water without gel formation.

2.3 125.1 g (0.44 mole ) of cocinyl alkyl-di-2-hydroxyethyl-amine, 80.0 g of water and 97.3 g (0.44 acid equivalents) of a mixture of mono- and didodecyl phosphate (molar ratio 1.5:1) were reacted as in 2.1 with 97.6 g (2.22 mole) of ethylene oxide. 395 g of a medium-viscosity, light-brown liquid was obtained which could be diluted easily with water to a slightly cloudy solution.

3. Production of aqueous emulsions containing the mixtures according to the invention (components A and B).

3.1

11.9 g of quaternary ammonium phosphate from example 2.1 was diluted with 25.6 g of water and then mixed with 5.4 g of an oleyl/cetyl alcohol mixture alkoxylated with 5 mole of ethylene oxide. A pH value of 5.2 was obtained by adding 9.5 g of 40% by weight acetic acid and the mixture was mixed with 47.6 g of the aqueous emulsion of example 1.1. A storage-stable, liquid, milky-white emulsion with a solids content of 25% by weight and a pH value of 4.5 was formed.

3.2

11.9 g of quaternary ammonium phosphate from example 2.2 was diluted with 25.6 g of water and mixed with 5.4 g of an oleyl/cetyl alcohol mixture alkoxylated with 5 mole of ethylene oxide. A pH value of 5.2 was obtained by adding 9.5 g of 40% by weight acetic acid and the mixture was mixed with 47.6 g of the aqueous emulsion of example 1.2. A storage-stable, liquid, milky-white emulsion was formed having a solids content of 25% by weight and a pH value of 4.5.

3.3

11.9 g of quaternary ammonium phosphate from example 2.3 was diluted with 25.6 g of water and mixed with 5.4 g of an oleyl/cetyl alcohol mixture alkoxylated with 5 mole of ethylene oxide. A pH value of 5.2 was obtained by adding 9.5 g of 40% by weight acetic acid and the mixture was mixed with 47.6 g of the aqueous emulsion of example 1.1. A storage-stable, liquid, milky-white emulsion was formed having a solids content of 25 % by weight and a pH value of 4.5.

4. Comparative product

Fatty alkyl amidoamine based on hardened beef tallow and aminoethyl ethanolamine (Belfasin ® 44, Henkel KGaA)

5. Application in the drawing process 5.1 Polyester staple fiber;

Colored and reductively after-treated polyester staple fiber material (1.7 dtex/40 mm) was treated at a liquor ratio of 1:10 for 20 minutes at a temperature of 60° to 70° C. with an aqueous acetic acid solution which, calculated on the weight of the goods, contained 2% by weight of each of the mixtures described under examples 1., 2., 3. or 4. After the application, the material was spun and dried for 2 hours at 80° C.

The determination of the electrostatic charge was carried out on a laboratory card after a 24-hour climatization (22° C., 62 to 65% relative humidity) of the fiber material with an Eltex apparatus according to the induced flow method (measuring distance 100 mm). These results are summarized in Table 1.

TABLE 1

| Polyester staple fiber treated with | | electrostatic charge $KVm^{-1}$ |
|---|---|---|
| | — | −60 to −80* |
| Ex. | 1.1 | −60 |
| | 2.1 | −8.0 |
| | 3.1 | −4.5 |
| | 3.2 } according to the invention | −3.5 |
| | 3.3 | −2 to −3* |
| | 4 | −60 |

*Only a value-range could be given for the electrostatic charge.

5.2 Polyester slubbing

Colored and reductively after-treated polyester slubbing (20 g/m; 6.7 dtex/80 mm) was treated at a liquor ratio of 1:15 for 20 minutes at a temperature of 60° to 70° C. with an aqueous acetic acid solution which, calculated on the weight of the goods, contained 2% by weight of each of the mixtures described under examples 1., 2., 3. or 4. When the re-texturing was complete the slubbing was spun and dried for 2 hours at 80° C.

The determination of the electrostatic charge was carried out on an intersecting gill drawing frame during the drawing process (delivery rate V=150 m/min) according to the induced flow measuring method between the drawing frame exit and coiler entrance at a distance of 100 mm. These results are summarized in Table 2.

TABLE 2

| Polyester slubbing treated with | | electrostatic charge $KVm^{-1}$ |
|---|---|---|
| | — | < −200 |
| Ex. | 1.1 | approx. −180 |
| | 2.1 | −9.0 |
| | 3.1 | −2 |
| | 3.2 } according to the invention | −3 |
| | 3.3 | −0.5/−1 |
| | 4 | < −200* |

*The symbol < means that the absolute value is greater than 200, e.g. −300.

The slivers produced on the gill box were evaluated according to the cohesion meter measuring method. The measured values cN. $tex^{-1}$ represent the forces occurring during a draught of x 1.25, which is necessary to effect a change in the length of the output material. The measurements recorded in Table 3 were prepared statistically via a Rothschild F- meter with the aid of a connected mini-computer.

TABLE 3

| Polyester slubbing treated with | | Draught force F ($cNtex^{-1}$) | S | CV (%) | Fmax ($cNtex^{-1}$) | Fmin |
|---|---|---|---|---|---|---|
| Ex. | | | | | | |
| — | | 19.02 | 7.6 | 39.95 | 49.4 | 2.4 |
| 1.1 | | 14.9 | 5.5 | 36.9 | 47.0 | 8.8 |
| 2.1 | | 19.0 | 8.7 | 45.79 | 55.0 | 10.8 |
| 3.1 | | 15.0 | 5.1 | 34.0 | 31.2 | 2.0 |
| 3.2 } | according to | 11.49 | 3.5 | 30.46 | 29.0 | 3.7 |
| 3.3 | the invention | 15.8 | 5.5 | 34.8 | 33.0 | 1.5 |
| 4 | | 19.00 | 7.3 | 38.42 | 50.0 | 2.7 |

F = draught force
S = standard deviation
CV = coefficient of variation

We claim:

1. A textile drawing aid mixture comprising from between about 5 and about 50% by weight, based on the weight of said mixture.

(A) an oxidized polyethylene having an average molecular weight between about 3,000 and about 8,000, an acid value between about 25 and about 60, a saponification value between about 40 and about 80 and a density between about 0.94 and about 1.09 $g/cm^3$, and (B) at least one quaternary ammonium phosphate selected from the following groups:

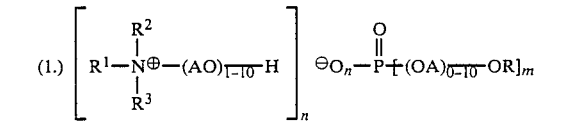

(1.)

in which $R^1$ represents a saturated or unsaturated, straight- or branched-chain, substituted or unsubstituted alkyl group with 6 to 22 carbon atoms or

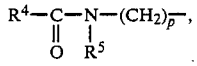

$R^2$ represents $(AO)_{1-5}$—H, methyl or ethyl, $R^3$ represents $(AO)_{1-5}$—H, methyl or ethyl or $R^2$ and $R^3$ together represent —$CH_2CH_2$—O—$CH_2CH_2$—, $R^4$ represents a saturated or unsaturated, straight- or branched-chain, substituted or unsubstituted alkyl group with 5 to 21 carbon atoms, $R^5$ represents H or an alkyl group with 1 to 4 carbon atoms, R represents a saturated or unsaturated, straight- or branched-chain, substituted or unsubstituted alkyl group with 6 to 22 carbon atoms and A represents an alkylene chain with 2 to 4 carbon atoms P is 2 or 3, and n=1, m=2 or n=2, m =1;

(2.) 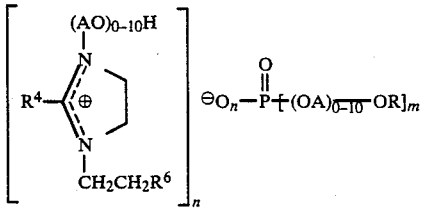

in which $R^4$ represents a saturated or unsaturated, straight- or branched-chain, substituted or unsubstituted alkyl group with 5 to 21 carbon atoms, $R^6$ represents OH or $$-NH-\underset{\underset{O}{\|}}{C}-R^4$$

R represents a saturated or unsaturated, straight- or branched-chain, substituted or unsubstituted alkyl group with 6 to 22 carbon atoms, and A represents an alkylene chain with 2 to 4 carbon atoms, and n=1, m=2 or n=2, m =1;

(3) a quaternary ammonium phosphate based on a polyester with amino functions having a degree of polymerization of between about 2 and about 50 produced by the reaction of a dicarboxylic acid of the formula $$HOOC-R^7-COOH$$

in which $R^7$ represents an aliphatic, alicyclic or aromatic, substituted or unsubstituted radical with 1 to 10 carbon atoms, with an alkoxylated tertiary amine of the formula $$H-(OA^1)_a-\underset{\underset{R^8}{|}}{N}-(A^1O)_b-H$$

in which $R^8$ represents a saturated or unsaturated, straight- or branched-chain, substituted or unsubstituted alkyl group with 1 to 20 carbon atoms, and $A^1$ represents an alkylene chain with 2 to 3 carbon atoms, a and b each represent an integer between 1 and 20 with the proviso that the sum a+b is from 2 to 50, and subsequent reaction with mono- and/or di-alkyl phosphoric acid esters of the formulae $$(HO)_2\overset{\overset{O}{\|}}{P}-(OA)_{\overline{0-10}}-OR, \text{ and}$$

$$HO-\overset{\overset{O}{\|}}{P}-[(OA)_{\overline{0-10}}-OR]_2$$

in which

R represents a saturated or unsaturated, straight- or branched-chain, substituted or unsubstituted alkyl group with 6 to 22 carbon atoms, and A represents an alkylene chain with 2 to 4 carton atoms, at 50° to 80° C. in the presence of water, and then reaction with an alkylene oxide containing 2 to 4 carbon atoms at a pressure between about 1 and about 5 bar and a temperature between about 80° and about 100° C., with the proviso that the polyalkylether chain of the quaternized amine functions contains 1 to 10 alkylene oxide units wherein the weight ratio of the components A:B is between 10:1 and 1:5.

2. A mixture according to claim 1 wherein said oxidized polyethylene has an average molecular weight of between about 3,500 and about 5,000 and a density of between about 0.98 and about 1.00 g/cm$^3$.

3. A mixture according to claim 1 wherein in the formulae for components B.(1) to (3.)

$R^1$ represents a saturated, straight- or branched-chain, substituted or unsubstituted alkyl group with 8 to 18 carbon atoms or an unsaturated, straight- or branched-chain, substituted or unsubstituted alkyl group with 18 to 22 carbon atoms, or $$R^4-\underset{\underset{O}{\|}}{C}-NH-(CH_2)_{\overline{p}}-,$$

$R^4$ represents a saturated, straight- or branched-chain substituted or unsubstituted alkyl group with 7 to 17 carbon atoms or an unsaturated, straight- or branched-chain substituted or unsubstituted alkyl group with 17 to 21 carbon atoms, A represents an ethylene or isopropylene group, $R^6$ represents OH, $R^8$ represents a saturated or unsaturated, straight- or branched-chain, substituted or unsubstituted alkyl group with 6 to 20 carbon atoms, and R represents a saturated, straight- or branched-chain, substituted or unsubstituted alkyl group with 8 to 18 carbon atoms or an unsaturated straight- or branched-chain, substituted or unsubstituted alkyl group with 18 to 22 carbon atoms.

4. A mixture according to claim I in the form of a solution, or a dispersion.

5. A mixture according to claim 4 containing from about 2 to about 20% by weight of a nonionic, cationic or amphoteric dispersant.

6. A mixture according to claim 4 containing an alkoxylated fat, oil, fatty alcohol with 8 to 24 carbon atoms in the fatty radical, fatty amine with 8 to 24 carbon atoms in the fatty radical, or $C_{8-18}$-alkyl phenol.

7. The process of rendering polyester-containing staple fiber materials antistatic, smooth or soft comprising contacting said fiber materials with a mixture comprising from between about 5 and about 50% by weight, based on the weight of said mixture, (A) an oxidized polyethylene having an average molecular weight between about 3,000 and about 8,000, an acid value between about 25 and about 60, a saponification value between about 40 and about 80 and a density between about 0.94 and about 1.09 g/cm$^3$, and (B) at least one quaternary ammonium phosphate selected from the following groups:

(1.) 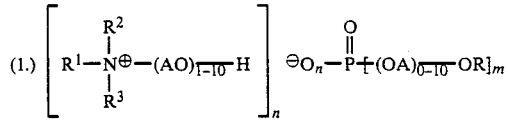

in which $R^1$ represents a saturated or unsaturated, straight- or branched-chain, substituted or unsubstituted alkyl group with 6 to 22 carbon atoms or $$R^4-\underset{\underset{O}{\|}}{C}-\underset{\underset{R_5}{|}}{N}-(CH_2)_{\overline{p}},$$

$R^2$ represents $(AO)_{1-5}$—H, methyl or ethyl, $R^3$ represents $(AO)_{1-5}$—H, methyl or ethyl or $R^2$ and $R^3$ together represent $-CH_2CH_2-O-CH_2CH_2-$, $R^4$ represents a saturated or unsaturated, straight- or branched-chain, substituted or unsubstituted alkyl group with 5 to 21 carbon atoms, $R^5$ represents H or an alkyl group with 1 to 4 carbon atoms, R represents a saturated or unsaturated, straight- or branched-chain, substituted or unsubstituted alkyl group with 6 to 22 carbon atoms, and A represents an alkylene chain with 2 to 4 carbon atoms P is 2 or 3, and n=1, m=2 or n=2, m=1;

(2.)

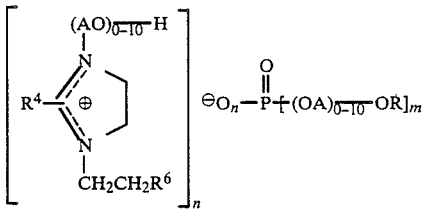

in which $R^4$ represents a saturated or unsaturated, straight- or branched- chain, substituted or unsubstituted alkyl group with 5 to 21 carbon atoms, $R^6$ represents OH or $$-NH-\underset{\underset{O}{\|}}{C}-R^4$$

R represents a saturated or unsaturated, straight- or branched-chain, substituted or unsubstituted alkyl group with 6 to 22 carbon atoms, and A represents an alkylene chain with 2 to 4 carbon atoms, and n=1, m=2 or n=2, m=1;

(3.) a quaternary ammonium phosphate based on a polyester with amino functions having a degree of polymerization of between about 2 and about 50 produced by the reaction of a dicarboxylic acid of the formula $$HOOC-R^7-COOH$$

in which $R^7$ represents an aliphatic, alicyclic or aromatic, substituted or unsubstituted radical with 1 to 10 carbon atoms, with an alkoxylated tertiary amine of the formula $$H-(OA^1)_a-\underset{\underset{R^8}{|}}{N}-(A^1O)_b-H$$

in which $R^8$ represents a saturated or unsaturated, straight- or branched- chain, substituted or unsubstituted alkyl group with 1 to 20 carbon atoms, and $A^1$ represents an alkylene chain with 2 to 3 carbon atoms, a and b each represent an integer between 1 and 20 with the proviso that the sum a +b is from 2 to 50, and subsequent reaction with mono- and/or di-alkyl phosphoric acid esters of the formulae $$(HO)_{\overline{2}}-\overset{\overset{O}{\|}}{P}-(OA)_{\overline{0-10}}-OR, \text{ and}$$

$$HO-\overset{\overset{O}{\|}}{P}-[(OA)_{\overline{0-10}}-OR]_2$$

in which

R represents a saturated or unsaturated, straight- or branched-chain, substituted or unsubstituted alkyl group with 6 to 22 carbon atoms, and A represents an alkylene chain with 2 to 4 carbon atoms, at 50° to 80° C. in the presence of water, and then reaction with an alkylene oxide containing 2 to 4 carbon atoms at a pressure between about 1 and about 5 bar and a temperature between about 80° and about 100° C., with the proviso that the polyalkylether chain of the quaternized amine functions contains 1 to 10 alkylene oxide units.

8. The process according to claim 7 wherein said oxidized polyethylene has an average molecular weight of between about 3,500 and about 5,000 and a density of between about 0.98 to about 1.00 g/cm$^3$.

9. The process according to claim 7 wherein in the formulae for components (B.1) to (3.)

$R^1$ represents a saturated, straight- or branched-chain, substituted or unsubstituted alkyl group with 8 to 18 carbon atoms or an unsaturated, straight- or branched-chain, substituted or unsubstituted alkyl group with b 18 to 22 carbon atoms or $$R^4-\underset{\underset{O}{\|}}{C}-NH-(CH_2)_{\overline{p}},$$

$R^4$ represents a saturated, straight- or branched-chain, substituted or unsubstituted alkyl group with 7 to 17 carbon atoms, or an unsaturated, straight- or branched-chain, substituted or unsubstituted alkyl group with 17 to 21 carbon atoms, A represents an ethylene or isopropylene group, $R_6$ represents OH, $R_8$ represents a saturated or unsaturated, straight- or branched-chain, substituted or unsubstituted alkyl group with 6 to 20 carbon atoms, and R represents a saturated, straight- or branched-chain, substituted or unsubstituted alkyl group with 8 to 18 carbon atoms or an unsaturated straight- or branched-chain, substituted or unsubstituted alkyl group with 18 to 22 carbon atoms wherein the weight ratio of the components A:B is between 10:1 and 1:5.

10. The process according to claim 7 wherein said mixture is in the form of a solution, or a dispersion.

11. The process according to claim 10 wherein said mixture contains from about 2 to about 20% by weight of a nonionic, cationic or amphoteric dispersant.

12. The process according to claim 10 wherein said mixture contains an alkoxylated fat, oil, fatty alcohol with 8 to 24 carbon atoms in the fatty radical, fatty amine with 8 to 24 carbon atoms in the fatty radical, or $C_{8-18}$-alkyl phenol.

13. The process according to claim 7 including drying said fiber materials at a temperature from about 80° to about 160° C.

14. The process according to claim 7 wherein the pH of a liquor containing said mixture is from about 4.0 to about 7.0.

15. The process according to claim 7 wherein said fiber materials are contacted with a liquor containing said mixture at a temperature between about 40° C. and about 80° C.

* * * * *